United States Patent [19]

Bingham

[11] Patent Number: 4,527,383

[45] Date of Patent: Jul. 9, 1985

[54] THREADS FOR IDENTIFICATION OF GARMENTS

[75] Inventor: Wallace K. Bingham, North St. Paul, Minn.

[73] Assignee: Minnesota Mining and Manufacturing Company, St. Paul, Minn.

[21] Appl. No.: 479,464

[22] Filed: Mar. 28, 1983

[51] Int. Cl.[3] ..... D02G 3/34; D02G 3/06

[52] U.S. Cl. ..... 57/200; 57/6; 57/31; 57/259; 57/260; 428/916

[58] Field of Search ..... 57/259, 200, 260, 6, 57/7, 8, 31, 32; 427/256; 428/914, 915, 916, 917; 40/2 R, 2 A, 360, 2.2; 2/243 R; 355/40, 77; 430/10, 18

[56] References Cited

U.S. PATENT DOCUMENTS

| | | | |
|---|---|---|---|
| 2,031,267 | 2/1936 | Koon | 57/233 |
| 3,053,039 | 9/1962 | Demmel | 57/295 |
| 3,154,872 | 11/1964 | Nordgen | 428/916 X |
| 3,623,808 | 11/1971 | Bassner | 355/40 |
| 4,350,437 | 9/1982 | Fishburn | 355/77 X |
| 4,384,018 | 5/1983 | Caswell et al. | 57/260 X |
| 4,397,142 | 8/1983 | Bingham | 57/238 |

*Primary Examiner*—Donald Watkins

*Attorney, Agent, or Firm*—D. M. Sell; J. A. Smith; D. B. Little

[57] ABSTRACT

A thread is provided which comprises a polymeric material onto which has been fixed a symbol or repeating multiple symbols which are detectable and readable under magnification. When incorporated into garments or garment labels, this thread is useful in identifying the true manufacturer of the goods, and the absence of such threads would help in the detection of counterfeit goods.

18 Claims, 2 Drawing Figures

THREADS FOR IDENTIFICATION OF GARMENTS

TECHNICAL FIELD

This invention is in the field of fabrics or garments. More specifically, it deals with the use of coded threads as a means for identifying garments or any other goods of which threads may be a component.

BACKGROUND

A major problem for manufacturers of popular trademarked items is the sale of counterfeit goods carrying a counterfeit label purporting to identify the goods as made by the trademark owner. The manufacturers of counterfeited items are desirous of products and procedures by which they could provide counterfeit-resistant labels or means, so that retailers, consumers, investigators and other persons could readily detect whether the label or garment was a genuine one.

Existing techniques for the identification of articles for purposes of theft prevention or prevention of counterfeiting include light coding of a spot on the article. The pattern produced by shining an intense beam of light through a spot on the article is read with a solid state image sensor having a grid of light sensing elements. The image on the grid is translated by a computer into a digital code number which identifies the material. Decoding requires subjecting the article again to the same light reading process and comparing the new data to the retained digital code. This light reading system requires somewhat expensive and sophisticated equipment for both encoding, storage and decoding the coded message.

In the thread-making art, there are known techniques for slitting a sheet material such as polyester into narrow widths in a conventional slitting or cutting apparatus. The resulting thin strands or fibers are received and stored on spools. The width of the strands may vary but will normally be somewhere in the range of 0.135 to 0.37 mm. A useful procedure for forming such strands or fibers from a sheet material is described in U.S. Pat. No. 4,336,092 which is incorporated herein by reference.

The present invention draws upon this slitting technology to arrive at an improved thread for identification purposes.

DISCLOSURE OF INVENTION

A new thread or yarn is provided which may be used to manufacture distinctive and counterfeit-inhibiting garments or garmet labels. This thread comprises a filament which carries a symbol or series of symbols which are detectable and readable under magnification. The maximum height of each micro-symbol is preferably about 50 percent of the threaded width. This percent is approximately the maximum which will ensure that at least one complete set of symbols will fit within the slit width of a slit fiber. In slitting a sheet carrying symbols of greater height, it is possible to cut through all the symbols leaving none intact. More preferably a 43 percent maximum height should be specified to allow for some space between adjacent rows of symbols. The symbols or code may be numbers, letters, words or any alpha-numeric combination which can be repeated a multiplicity of times. They may also be geometric shapes, bar codes or other intelligible symbols. The thread is designed to be used in either weaving or knitting fabric for a garment or garment label, or in the tailoring of a garment. Identification and detection of this thread and the code inscribed thereon would not require extraordinary or peculiar equipment.

In a preferred method of making this thread, a film of polymeric material is made into a photosensitive microfilm by coating it with various chemical compositions. The coated photosensitive film is protected from exposure to strong light until it can be exposed to the appropriate light through a negative (such as a microfilm or microfiche negative) containing the coding information typically at a reduction of 1:24 to 1:96. Exposure to the coded message and subsequent developing are repeated until the desired quantity of film is made.

The exposed and developed film is converted to a thread by slitting it to a convenient thread width. This width should be such that the material can be manipulated as a thread in typical sewing, knitting and weaving machinery.

The encoded information contained in a thread of this type is easily read by looking at a segment of the thread or yarn under magnification, generally with a light magnifier. Since the information on the thread generally comprises a repeating series of symbols extending along the length of the thread, any thread segment will suffice.

The coded strands can be used alone, and they can also be twisted together with other threads (e.g., two strands of 150 denier polyester filament). The single filament would be useful in knitting applications, and the twisted or twined thread would be useful in weaving or sewing applications. Coded garments or garment labels would be prepared using the thread, typically as a minor component.

This system of garment or product identification has several advantages. It can use easily detectable and readable alphanumerics which typically can be seen at 15 to 100 × magnification without the need of sophisticated equipment. The code itself is easily changed, thus making counterfeiting of the code difficult. The thread with the code can be made to survive multiple launderings. Also, this thread can be easily put into labels, seams, or into the fabric of a garment itself.

BRIEF DISCUSSION OF THE FIGURES

DETAILED DESCRIPTION OF THE INVENTION

Figure 1:
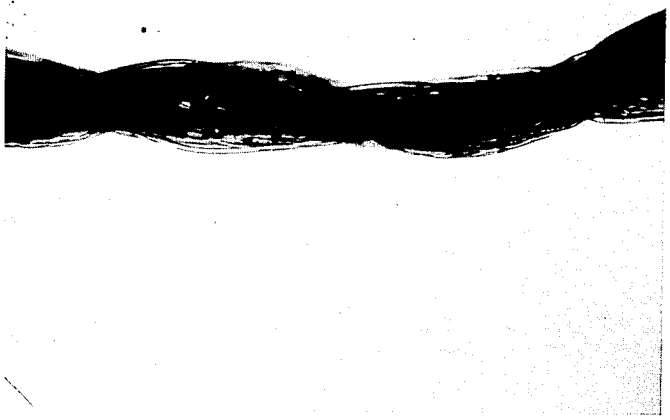
FIG. 1 is a photomicrograph (magnified 50×) of a three-filament thread of this invention. The dark central filament is the core filament which is coded.
Figure 2:
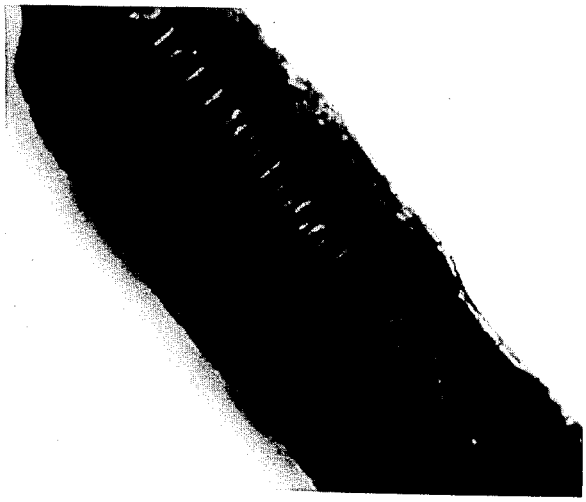
FIG. 2 is a photomicrograph (magnified 200×) showing the coded filament used for the core filament of FIG. 1.

Materials useful as the polymeric film include: polyester; nylon polyvinyl chloride; polypropylene; polycarbonate; polyvinylidine chloride; and cellulose acetate. The polymeric material used should have sufficient tensile strength so that it would not stretch or sag during the process of manufacture or during use of the fabric itself to such an extent that the coded message would be distorted or destroyed. Preferably, the tensile strength of the material is at least 8000 pounds per square inch (55.12MPa), and its initial tear strength is at least 500 pounds force (2,225 N) for a one mil (25.4 microns) thick film. Dimensional stability of the material must be sufficient to maintain the legibility of the code.

In one example of the manufacture of the coded thread, a thermo-diazo, photosensitive coating on polyester film is made by first priming a 1 mil (25.4 micron) polyester film by reverse roll coating a 15% solids solution of a polyester primer in a solution of methyl ethyl ketone and toluene at about 2½ mils (63.5 microns) wet coating thickness. The polyester primer used in developing this invention was a linear, saturated polyester obtained as Vitel PE 307 polyester from Goodyear Tire & Rubber Company. The process of reverse roll coating is well known and is described in Booth, G.L., *Coating Equipment and Processes,* Lockwood Publishing Co., Inc., New York, 1970, p. 140. The film to be coated is contacted with an applicator roll which has been wetted with coating liquid, and the quantity of liquid is controlled by contacting either the applicator roll or the film web itself with a metering roll as the film is conveyed through the process. The primed film is oven-dried at about 77° C. A second coating is applied in an identical manner with the following formulation:

TABLE 1

| COMPONENT | WEIGHT PERCENT |
|---|---|
| Methyl Ethyl Ketone | 40.5 |
| Methanol | 40.5 |
| Butyl Alcohol | 7.74 |
| Cellulose Acetate Propionate | 8.52 |
| 5 Sulfosalicylic Acid | .60 |
| 3-Hydroxy-2-naphtho-0-phenetidide Dye | .82 |
| 2, 3 Dihydroxynapthalene | .20 |
| 1-Diazo-2,5-Diethoxy-4-Morpholino-benzene Borofluoride | 1.0 |
| Cyanoacetyl Morpholoid | .12 |

With this sort of coating called an ammonia /diazo coating, the image is developed in an ammonia atmosphere at elevated temperature, typically 177° C. A 1:48 reduction is normal for this process; although, a 1:96 reduction is possible. Resolution becomes difficult at further reduction. The coated, photosensitive film is protected from exposure to light until it is exposed to the intended image and developed.

A second means for imparting the code to a polymer base material is exemplified as follows: A 0.92 mil (23 micron) thick polyester film is reverse roll coated with a photosensitive solution whose composition is as follows:

TABLE 2

| COMPONENT | WEIGHT PERCENT |
|---|---|
| Methyl Ethyl Ketone | 86.17 |
| Alpha-chloroacrylonitrile Copolymer Resin | 9.93 |
| Polyvinylidine Chloride Resin | 1.99 |
| Polyalkyleneoxide modified dimethylpoly-siloxane (obtained as Silwet TM L-722 Silcone fluid from Union Carbide Corporation) | .06 |
| Citric Acid | .71 |
| 1-Diazo-2,5-Diethoxy-4-Morpholinobenzene Borofluoride | .92 |
| Blue Anthroquinone type Dye (obtained as Solvent Blue 45 Dye) | .22 |

This coating system, known as a vesicular system, does not require a primer or an ammonia atmosphere for developing. Once exposed to the microfilm negative (for example, having a 1:24 image reduction), the coated polyester is simply contacted with a hot rotating drum at elevated temperature (typically about 177° C.) which has the effect of forming micro-bubbles to give the coded message. This developing process can be performed on commercially available machines such as the Canon Microfilm Roll Duplicator 460. In such a machine, the film is conveyed in register with the negative on an illuminated cylinder.

The photosensitive film may be subjected to the vacuum vapor deposition (also known as vacuum metallization) of some metal such as nickel (a 500 angstrom thickness being typical for the coating) in such a way that the coded image may still be read, e.g., on the side opposite the side to be coated with a photosensitive composition. Vacuum metallization is a well known process in which a metal source material in a crucible in an evacuated chamber is vaporized, and the metal vapors are condensed onto the substrate to be coated. The heating means is an electron beam (electron bombardment) directed toward the metal source (e.g. nickel in a graphite crucible or boat). The process is controlled by varying the power to the electron beam gun, the opening of the orifice or baffle through which the metal vapors must go to reach the substrate, and the length of time the substrate is exposed to the vapors. Ordinarily, the metal coating would be applied before the photosensitive chemicals.

With this metal coating, not only will the final thread be identifiable by the code; it will also physically respond to the influence of a magnetic field either by being repelled or attracted to the pull of a simple permanent magnet. Commonly this magnetic property is manifested by a thread segment standing on its edge. Occasionally the segment must be suspended in a transparent dielectric fluid in order to observe this magnetic effect. This is particularly true if the metal coating is in the order of 200 angstroms thickness or less. Also, the thread is made more visibly distinctive because of its metallic glitter and can thus be more readily located.

Several other metals and alloys beside nickel can be used in such coatings. These include iron and cobalt. This metal coating would make counterfeiting of the coded threads even more difficult.

The polymeric film web typically is conveyed through the photo-sensitive chemical coating process at about 30 meters per minute and through the exposure and developing process at about 15 to 25 meters per minute. In the research and development work leading to this invention, the web of polymeric material which was treated with photo-sensitive coating and developed was typically 152 mm (6 inches) wide, and this was slit into strips 51 mm (2 inches) wide which were wound up into rolls which were later slit further into fibers or strands.

A useful procedure for making a composite thread or yarn in which a filament of the coded polymeric material is intertwined with other filaments or threads is described in U.S. Pat. No. 3,382,655 which is incorporated herein by reference. The coded thread would simply be substituted for the core yarn (designated as Item 11 in the '655 patent). In that method, the core yarn is drawn through several rotating spools of yarn, and after passing each spool, it is wrapped with the yarn from each respective spool in one direction or another. Adjustments can be made in the speeds of the rotating spools and the take-up roll which accumulates the final wrapped thread or yarn, in order to change the amount or spacing of the wrapping threads.

Normally, the wrapping threads in a twined product as described above are somewhat loose about the core thread. However, in a sewing machine application, somewhat stronger threads are needed. Therefore, for sewing machine threads used in sewing the seams of garments, it is preferable that the wrapping threads be multifilament (e.g., 12 filament) threads of some material such as polyester.

In the case of the twined threads, it is normally necessary to unravel the wrapping threads from the core threads or filament in order to view the micrographics or coded message under a magnifier.

Other embodiments of this invention will be apparent to those skilled in the art from a consideration of this specification or practice of the invention disclosed herein. Various omissions, modifications, and changes to the principles described herein may be made by one skilled in the art without departing from the true scope and spirit of the invention which is indicated by the following claims.

What is claimed is:

1. A thread comprising a filament made of polymeric material to which has been applied a microscopic symbol which is visibly detectable and readable only under magnification.

2. The thread as recited in claim 1 wherein the polymeric material is selected from the group consisting of polyester, nylon, polyvinyl chloride, polypropylene, polycarbonate, polyvinylidine chloride and cellulose acetate.

3. The thread as recited in claim 1 wherein the symbol is selected from the group consisting of letters, numbers and combinations thereof.

4. A thread as recited in claim 1 which comprises a slit sheet material.

5. The thread of claim 1 in which the symbol has been formed by a process comprising: (a) coating the polymeric material with a photosensitive composition; (b) exposing the coated polymeric sheet material to light which has passed through a negative containing the symbol; (c) developing the image of the symbol on the polymeric material; and (d) slitting the polymeric material into strands which can be manipulated as threads.

6. The thread of claim 1 in which the symbols have a maximum dimension of about 50 percent of the thread width.

7. The thread as recited in claim 1 which has been intertwined with other fibers.

8. The thread as recited in claim 1 which has a metal coating on part of its surface which does not obscure the symbol.

9. A fabric into which the thread of claim 1 has been incorporated.

10. A garment into which the thread of claim 1 has been incorporated.

11. The thread as recited in claim 1 wherein the magnification required to detect and read the symbol is from 15 to 100×.

12. An encoded thread comprising a length of slit sheet material which carries a repeating series micro-symbols formed by a process comprising: (a) coating the sheet material with a photosensitive composition; (b) exposing the coated sheet material to light which has passed through a negative showing the symbols; (c) developing the image of the symbols on the sheet material; and (d) slitting the sheet material into strands which can be manipulated as threads.

13. The thread of claim 12 which is intertwined with other fibers.

14. A process for manufacturing a polymeric thread comprising the steps of:

(a) coating a polymeric material with a photo-sensitive chemical composition;

(b) exposing the coated polymeric material to light which has passed through a negative showing a symbol to be imparted to the polymeric film;

(c) developing the image of the symbol imparted to the film in step (b); and (d) slitting the polymeric film into strands which can be manipulated as threads.

15. The process as recited in claim 14 wherein the polymeric material in step (a) is a polymeric film selected from the group consisting of polyester, nylon, polyvinyl chloride, polypropylene, polycarbonate, polyvinylidine chloride and cellulose acetate.

16. The process as recited in claim 14 wherein the negative used in step (b) is a microfilm negative on which the image reduction is in the range of 1:24 to 1:96.

17. The process as recited in claim 14 which further comprises an additional step in between Steps (a) and (b), said additional step comprising the deposition of a metal coating on the side of the polymeric film opposite the side coated with the photo-sensitive composition.

18. The process as recited in claim 14 which further comprises (e) twisting the thread from Step (d) together with the other threads.

* * * * *